US005429239A

United States Patent [19]

Baxter

[11] Patent Number: 5,429,239

[45] Date of Patent: Jul. 4, 1995

[54] PACKAGE OF A TWO-TIER GROUP OF FLANGED ARTICLE AND METHOD OF FORMING THE SAME

[75] Inventor: Ronald A. Baxter, Douglasville, Ga.

[73] Assignee: The Mead Corporation, Dayton, Ohio

[21] Appl. No.: 225,169

[22] Filed: Apr. 8, 1994

[51] Int. Cl.[6] ..... B65D 5/02; B65D 65/12; B65D 75/28

[52] U.S. Cl. ..... 206/434; 229/103.2; 206/499

[58] Field of Search ..... 206/147, 152, 155, 156, 206/158, 427, 434, 526, 499; 229/40

[56] References Cited

U.S. PATENT DOCUMENTS

| | | | |
|---|---|---|---|
| 3,002,613 | 10/1961 | Merkel et al. . | |
| 3,409,124 | 11/1968 | Jorgensen | 206/434 |
| 3,680,691 | 8/1972 | Lock . | |
| 4,149,636 | 4/1979 | Pintsak et al. | 206/434 |
| 4,600,140 | 7/1986 | Milliens . | |
| 4,756,419 | 7/1988 | Le Bras . | |
| 4,932,531 | 6/1990 | Bakx . | |
| 5,000,313 | 3/1991 | Oliff . | |
| 5,163,548 | 11/1992 | Domansky | 206/158 |

FOREIGN PATENT DOCUMENTS

| | | |
|---|---|---|
| 1383034 | 11/1964 | France . |
| 1418015 | 10/1967 | France . |

*Primary Examiner*—Jacob K. Ackun
*Attorney, Agent, or Firm*—Tsugihiko Suzuki

[57] ABSTRACT

A package comprises a plurality of flanged articles arranged into a two-tiered group wherein the articles in the upper tier are positioned in top-to-top contacting relation with the articles in the lower tier. Each article has a tubular side wall with a peripheral flange at its top end. The articles are arranged such that the axes of the articles in each tier are disposed vertically and parallel to each other. The group of articles is covered by a sleeve-like carton which includes top and bottom panels interconnected by a pair of side panels and an article retainer for engagement with both the flanges of a pair of the vertically aligned articles located at one of the open ends of the carton. The top panel overlies the bottoms of the articles in the upper tier whereas the bottom panel underlies the bottoms of the articles in the lower tier. The side panels are disposed alongside the side walls of the articles.

19 Claims, 5 Drawing Sheets

PACKAGE OF A TWO-TIER GROUP OF FLANGED ARTICLE AND METHOD OF FORMING THE SAME

BACKGROUND OF THE INVENTION

The present invention relates generally to packaging a group of flanged articles such as yogurt cups, and more particularly to a package using a so called wrap-around carton which accommodates a group of flanged articles arranged in two tiers in a top-to-top contacting relation. The invention also relates to a method of forming such a package.

U.S. Pat. No. 4,932,531 discloses a package in which a multiple of flanged articles are accommodated in a wrap-around carton. The disclosed package includes a tubular, open-ended outer wrapper covering a group of flanged articles arranged in two tiers in a top-to-bottom contacting relation and a partition provided between the upper and lower tiers. Both the carton and the partition are provided with pairs of slots for receiving the article flanges to prevent endwise dislodgement of the articles from the carton. Each pair of slots are provided for one article.

French Patent No. 1,383,034 also shows a package of flanged articles arranged in two tiers. The package of this patent employs no partition between the two tiers; however, article-retaining flaps are separately formed respectively for the articles in the package.

The disadvantages of these conventional packages exist not only in the carton structures having a number of retaining means such as slots or flaps but also in the packaging process wherein two positioning processes, i.e., positioning of the articles in one of the tiers relative to those in the other tier and positioning of the carton relative to the two-tier group of articles, are separately required.

What is needed, therefore, is a package for a two-tier group of flanged articles which package is formed with a carton of a simple structure having a smaller number of retaining means per one article and a method of forming such a package that facilitates positioning processes for the carton and the packaged articles.

SUMMARY OF THE INVENTION

In meeting the foregoing needs, the present invention provides a package which accommodates a plurality of flanged articles arranged into a two-tiered group wherein the articles in the upper tier are positioned in top-to-top contacting relation with the articles in the lower tier.

Each article has a tubular side wall with a peripheral flange at its top end. The articles are arranged such that the axes of the articles in each tier are disposed vertically and parallel to each other.

The group of articles is covered by a carton sleeve which includes top and bottom panels interconnected by a pair of side panels and article retaining means for engagement with both the flanges of the pair of the vertically aligned articles located at one of the open ends of the carton. The top panel overlies the bottoms of the articles in the upper tier whereas the bottom panel underlies the bottoms of the articles in the lower tier. The side panels are disposed alongside the side walls of the articles.

The package of the invention is structurally simple in that the carton has a small number of article retaining means per one article as compared to conventional packages.

In a preferred embodiment, the one side panel is folded along a center fold line formed therein so that the upper portion of the one side panel is disposed in an angular relationship with the lower portion of the same panel. The retaining means is positioned adjacent to the center fold line.

A preferred embodiment of the article retaining means is a web structure which is interposed between inside surfaces of the upper and lower portions of the one side panel to be positioned astride the flanges of the end pair of the vertically aligned articles. The retaining means may include upper and lower anchoring flaps foldably joined respectively to the upper and lower portions at the one open end of the carton. The upper and lower anchoring flaps are folded into flat face contacting relation respectively with the inside surfaces of the upper and lower portions and are interconnected by the web structure.

Alternatively, the retaining means may be a slot formed in the one side panel so as to extend along the center fold line.

According to an alternate definition, the invention may provide a method of forming a package as previously defined. Such a method comprises arranging a plurality of the flanged articles into the two-tier group mentioned above, and covering the group of articles with a carton blank comprising a top panel, a pair of side panels foldably joined to the top panel, a pair of bottom flaps foldably joined respectively to the side panels, and article retaining means associated with one of the side panels. The covering process is carried out in the following manner. First, the carton blank is placed above the group of articles so that the top panel overlies the bottoms of the articles in the upper tier. Then, the side panels are folded down relative to the top panel towards the group of articles, and the retaining means is engaged at one time with both the flanges of the adjacent pair of the vertically aligned articles. After that, the bottom flaps are folded toward each other and secured together to form a composite bottom panel.

Due to the sequence of the above steps, the pair of articles engaged by the retaining means are automatically positioned correctly with respect to each other, and the carton is also automatically positioned correctly with respect to the pair of articles.

Other advantages and objects of the present invention will be apparent from the following description, the accompanying drawings, and the appended claims.

DETAILED DESCRIPTION OF THE PREFERRED EMBODIMENT

Figure 1:
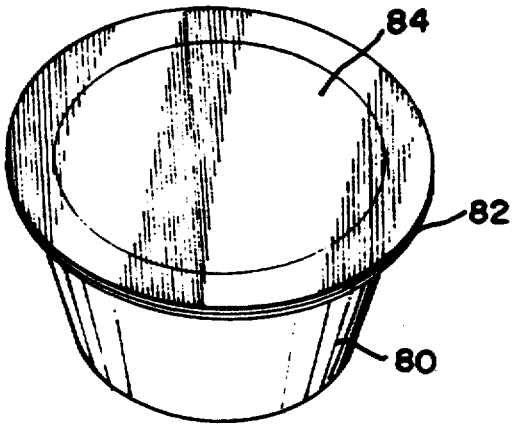
FIG. 1 is a perspective view of a typical plastic cup.

The present invention is intended primarily for use with plastic cups of the type used in packaging foods or beverages such as yogurt, puddings, mousses, jellies, fruit juice and the like. A typical example of such a cup includes a generally tubular tapered side wall with a closed bottom, a peripheral flange at the top end of the side wall and a lid ordinarily in the form of a film attached to the flange to seal the open top of the side wall. One type of such cups may be provided in a discrete or singular form wherein each cup is independent and separate from other cups. An example of such a cup is shown in FIG. 1 wherein the side wall, the flange and the lid are designated by the numerals 80, 82, 84 respectively. Another type of the cups may be provided in an interconnected or grouped form wherein a multiple of cups are interconnected at their flanges along perforated tear lines.

Figure 7:
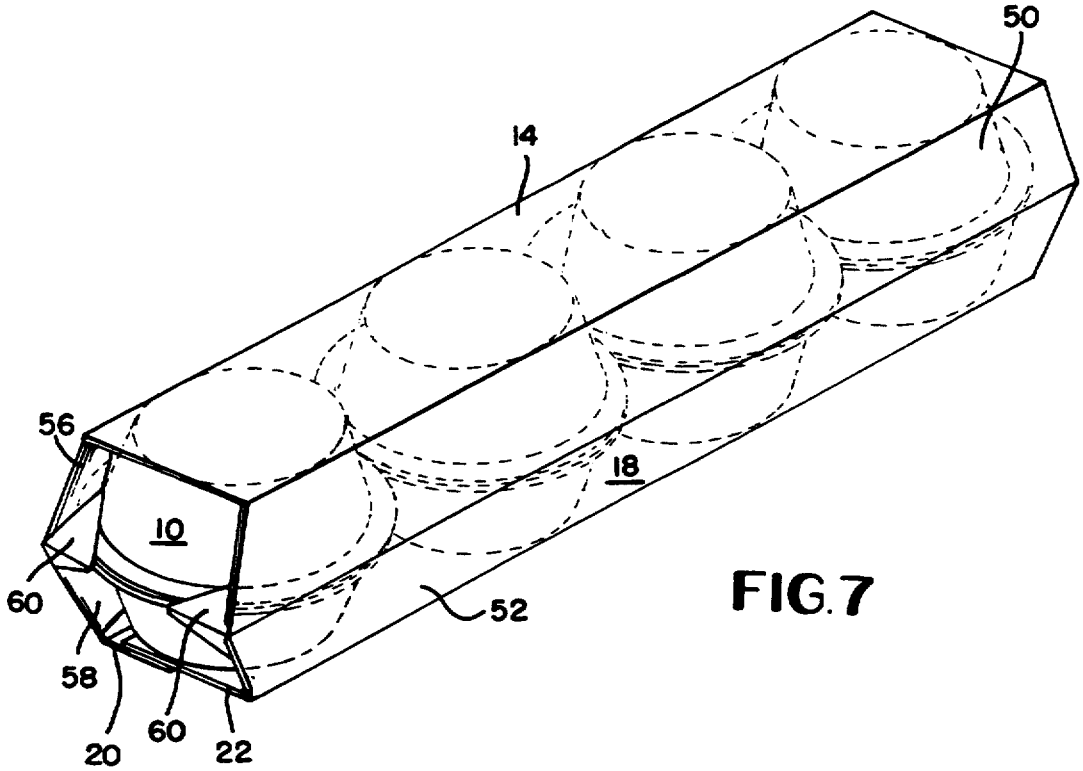
FIG. 7 is a perspective view of the completed package according to the invention.

In accordance with the invention, a package is provided wherein a plurality of cups such as described above is wrapped in a carton in a condition in which the cups are arranged in two tiers in a top-to-top contacting relationship. An example of such a cup arrangement can be seen by reference to FIG. 2 wherein two-tiers of four discrete cups 10 each are arranged to provide a package containing eight cups. According to one embodiment of the invention which is best illustrated in FIG. 7, it will be recognized that the invention may be used with two tiers of any number of cups wherein each tier consists of a single row of cups. However, when cups are of the interconnected type, the invention may be used with two tiers of any number of cups wherein each tier consists of any number of rows of cups.

Cartons useful in the invention are formed from paperboard or similar foldable sheet material. An example of such a carton is shown in blank form in FIG. 3 wherein the blank 12 includes a rectangular top panel 14, a pair of hexagonal side panels 16 and 18 and a pair of bottom flaps 20 and 22. The side panels 16 and 18 are foldably joined to the opposite side edges of the top panel 14 along fold lines 24 and 26. The bottom flap 20 is foldably joined to the side panel 16 along a fold line 28 at the edge opposite the fold line 24, likewise the bottom flap 22 is foldably joined to the side panel 18 along a fold line 30 at the edge opposite the fold line 26. These bottom flaps 20 and 22, when secured together, form a single composite bottom panel. For this purpose, locking tabs 32 and locking slits 34 are provided respectively for the flaps 20 and 22. The details of each locking tab 32 and each locking slit 34 are described in U.S. Pat. No.4,600,140 assigned to the Mead Corporation, which is hereby incorporated by reference. However, it should be readily understood that any other types of known panel securing/interconnecting means, including but not limited to other locking arrangements or glue, may be used in place of the tabs and slits 32 and 34 according to the invention.

Each of the side panels 16 and 18 comprises two adjacent portions of the same size and shape, and is provided with a center fold line extending along a notional border line between the two adjacent portions. More particularly, the side panel 18 has upper and lower trapezoidal portions 50 and 52 foldably joined at their longer parallel edges together along a center fold line 54. One oblique end edge 64 of the upper portion 50 and the adjacent end edge 66 of the lower portion 52 form a first corner of the panel 18 therebetween, and the other oblique end edge 74 of the upper portion 50 and the adjacent oblique end edge 76 of the lower portion 52 form a second corner therebetween. The aforementioned fold line 54 extends entirely between the first and second corners of the side panel 18. In like manner, the side panel 16 includes upper and lower trapezoidal portions 44 and 46 foldably joined together along a fold line 48 and first and second opposed corners virtually identical to those of the panel 18. The fold line 48 extends entirely between the first and second corners of the panel 16.

According to a feature of the invention, the side panel 16 is provided at its opposite end edges with article retainers 36 and 38 respectively. Likewise the side panel 18 is provided at its opposite end edges with article retainers 40 and 42 respectively. Since all the article retainers 36, 38, 40 and 42 are virtually identical, only the specific features of the retainer 40 will be described here in detail.

Figure 3:
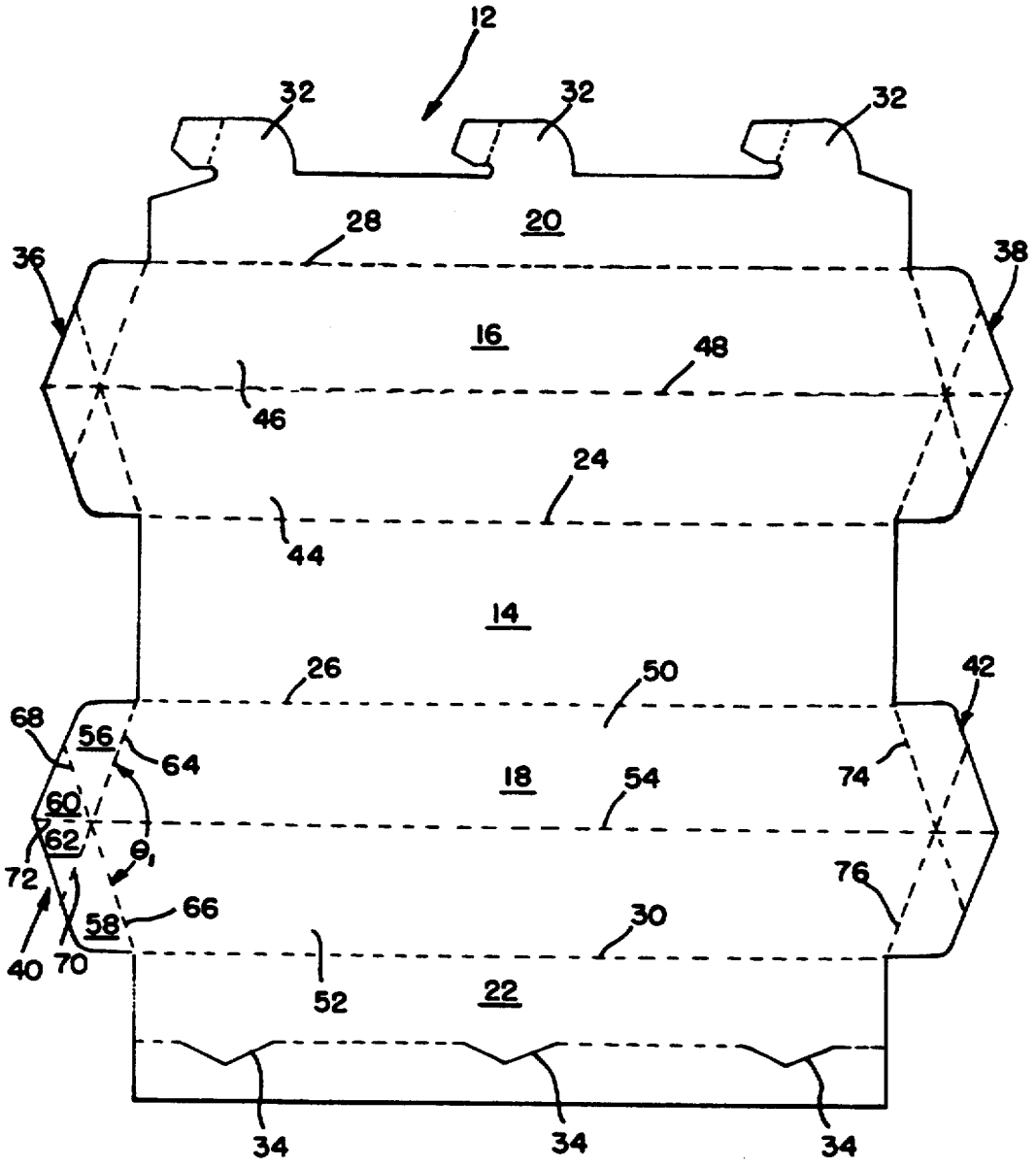
FIG. 3 is a plan view of the carton blank useful in the invention.

With particular reference to FIG. 3, the retainer 40 comprises a pair of anchor flaps 56 and 58 and a pair of triangular web flaps 60 and 62. The anchor flap 56 is foldably joined to the end edge of the upper panel portion 50 along a fold line 64. The other anchor flap 58 is foldably joined to the end edge of the lower panel portion 52 along a fold line 66. The web flap 60 is foldably joined to the lower edge of the anchor flap 56 along a fold line 68 which is collinear with the fold line 66. The other web flap 62 is foldably joined to the upper edge of the anchor flap 58 along a fold line 70 which is collinear with the fold line 64. The web flaps 60 and 62 are foldably interconnected together along a fold line 72.

Figure 6:
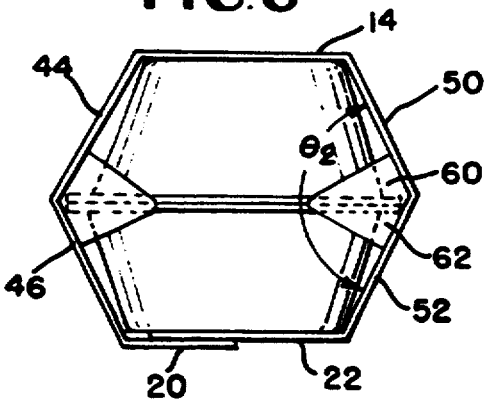

The angle $\Theta_1$ between the fold lines 64 and 66 is preferably an obtuse angle and is more preferably between 120 degrees and 180 degrees; however, the angle $\Theta_1$ may be any angle that allows the retainer 40 to form a three-dimensional web structure which will be described later. The angle $\Theta_1$, in fact, can be the function of the $\Theta_2$ between the upper portion 50 and the lower portion 52 as viewed in FIG. 6. The smaller the angle $\Theta_2$ is, the greater the angle $\Theta_1$ may be. For example, when the cups to be packaged are very steeply tapered and thus the angle $\Theta_2$ is relatively small (e.g., around 90 degrees), the angle $\Theta_1$ should be or should be close to 180 degrees in order to form a suitable web structure according to the invention. On the other hand, when the cups have almost no taper and thus the angle $\Theta_2$ is close to 180 degrees, the angle $\Theta_1$ should be close to 90 degrees. Stated differently, the more steeply the cups are tapered, the greater the angle $\Theta_1$ may be. This is because the side panels 16 and 18 of the carton are folded inwardly about their respective center fold lines 48 and 54 to conform in tapered fashion with the side walls of the packaged cups as best shown in FIG. 6.

Figure 2:
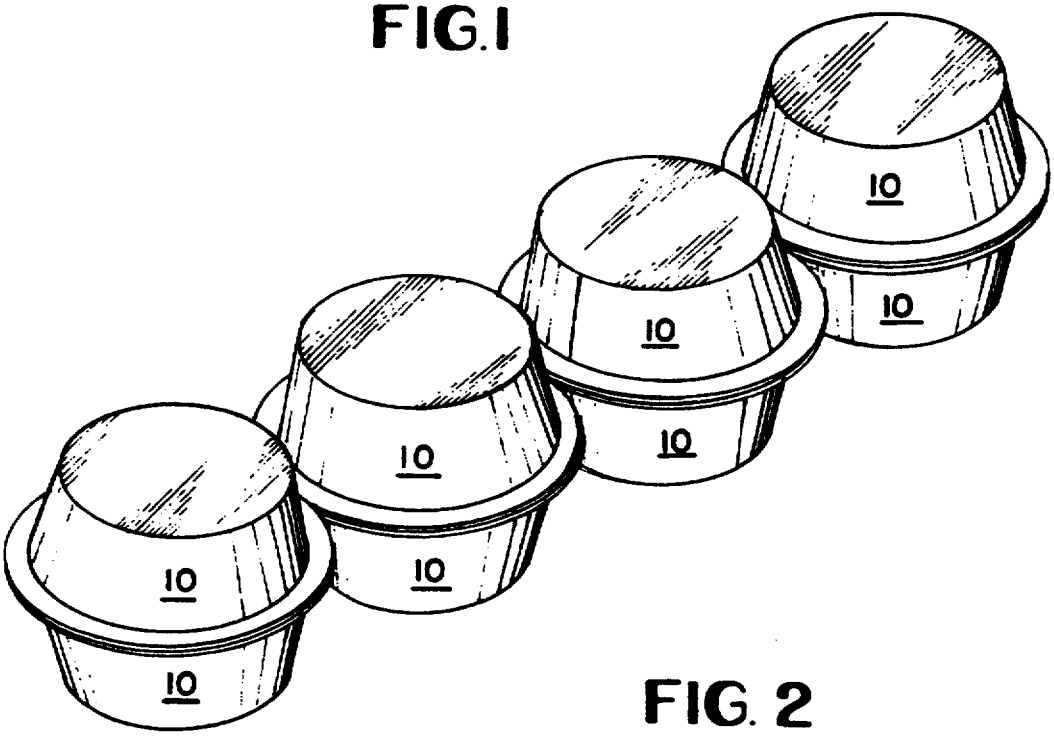
FIG. 2 is a perspective view of an example of two-tier group of cups which may be wrapped in a carton to provide a package according to the invention.

To assemble the cup arrangement shown in FIG. 2, four cups are arranged in a row to form the lower tier. Then, other four cups are arranged in a row in an inverted condition and are placed on top of the cups 10 in the lower tier to form the upper tier. As a result, the two-tier cup arrangement in FIG. 2 is prepared. Each cup 10 in the upper tier is generally vertically aligned with the respective cup in the lower tier; however, accurate positioning of the upper tier cups with respect to the lower tier cups is not necessary because of the covering/wrapping process which will be described hereinafter in detail.

The cup arrangement of FIG. 2 is wrapped with the carton blank 12 in the following manner to provide a complete package.

Figure 4:
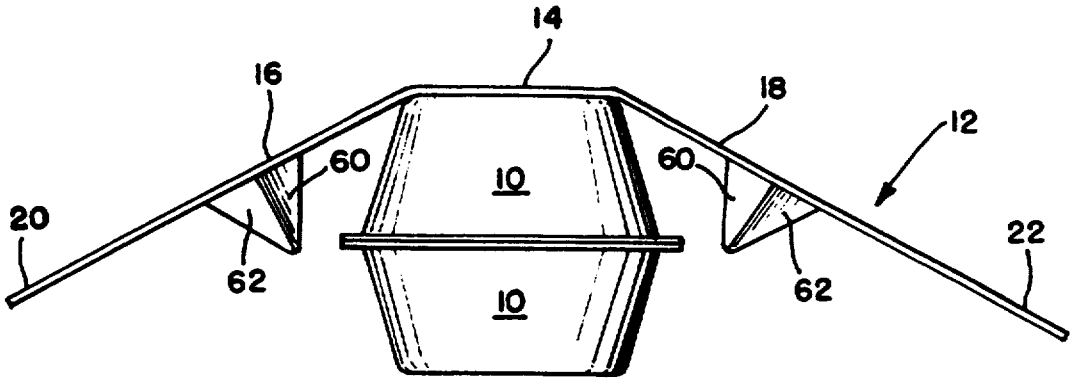
FIGS. 4 to 6 are front views of the cup group of FIG. 2, illustrating the process for covering the cup group.
Figure 5:
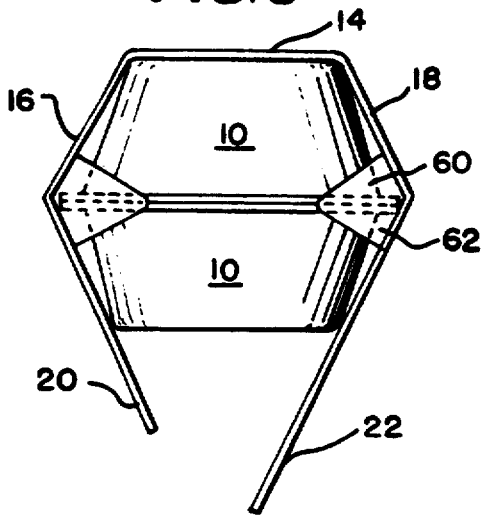
Figure 8:
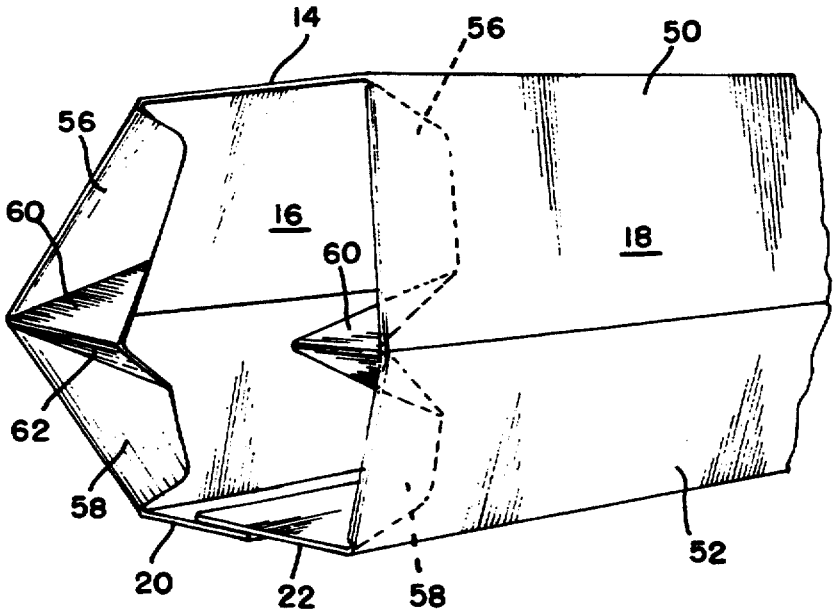
FIG. 8 is a fragmentary perspective view of the carton of FIG. 3 in an assembled condition.

The carton blank 12 is placed above the cup arrangement so that the top panel 14 overlies the bottoms of the cups 10 in the upper tier, as shown in FIG. 4. Then, the anchoring flaps 56 and 58 of all the retainers 36, 38, 40 and 42 are folded into flat face contacting relation with the adjacent inner surfaces of the side panels 16 and 18. This causes the web panels 60 and 62 of each retainer to be folded about the fold lines 68, 70 and 72 so that they are formed into a three-dimensional web structure projecting from the inner surface of the respective side panel as best shown in FIGS. 4 and 8. At the same time or subsequently, the side panels 16 and 18 as well as the bottom flaps 20 and 22 are folded down about the fold lines 24 and 26, and the side panels 16 and 18 are folded about their respective center fold lines 48 and 54 to be disposed generally along the tapered side walls of the cups in the cup arrangement (see FIG. 5). By this means, the anchor panels 56 and 58 of all the retainers 36, 38, 40 and 42 engage the side walls of the adjacent cups 10 respectively and are thereby held in the folded positions. Meanwhile, the web structures at each end of the partially assembled carton are disposed astride the mated flanges of the pair of upper and lower cups 10 at the respective end of the cup arrangement as best shown in FIG. 5. This, in other words, means that the flanges of the pair of upper and lower cups 10 at one end of the cup arrangement are enveloped and engaged by the common article retainers 36 and 40 whereas the flanges of the pair of upper and lower cups 10 at the other end of the cup arrangement are enveloped and engaged by the common article retainers 38 and 42. As is obvious, this step automatically causes the cups of the upper tier to be accurately aligned with the respective cups in the lower tier and also causes the carton to be correctly positioned with respect to the cup arrangement. It should be noted that the web structures are held in the three-dimensional condition and thereby engage the cup flanges as long as the respective anchor flaps are held in the folded positions.

After the foregoing steps, the bottom flaps 20 and 22 are folded toward each other about the fold lines 28 and 30 and are secured together by means of the tabs and slits 32 and 34 to complete the package (see FIG. 6). Details regarding the securing of the bottom flaps 20 and 22 may be found by reference to the aforementioned U.S. Pat. No. 4,600,140. When interconnected, the bottom flaps 20 and 22 form a composite bottom panel which underlie the bottoms of the cups in the lower tier.

FIG. 7 shows the completed package. This package has a good integrity in that the web structures prevent the cups 10 from dislodgement through the carton ends and in that the carton tightly fits around the cup arrangement with little gap therebetween as compared to conventional packages. Further more, the package in FIG. 7 is structurally simple and strong in that the carton has no slot for receiving the cup flanges. These benefits owe to the package structure wherein the packaged cups are arranged in two tiers in top-to-top contacting relationship and wherein the pair of upper and lower cups at each carton end are engaged by a common retainer.

It would be recognized that variations may be made to the foregoing within the scope of the present invention. For example, it would be possible to omit one of the aforementioned retainers 36 and 40 and/or one of the retainers 38 and 42. Such an arrangement requires less carton material and may also simplify the package forming process. It should be further recognized that it would be also possible to omit all the retainers 36, 38, 40 and 42 but one. In such an arrangement, some other means for retaining articles should, of course, be provided at the end of the carton where no retainer is provided.

It should be further recognized that cups of the interconnected type may be used with the invention. Because the cups of this type are interconnected at their flanges, one web structure at each end of the carton would function to maintain all the cups within the carton. With this type of cups, any desired two-tiered cup arrangement may be used. Such an arrangement may include a two-tier cup group wherein each tier constitutes one row of two, three, four or five cups, two rows of three, four or five cups or a greater number of rows of a desired number of cups.

Figure 9:
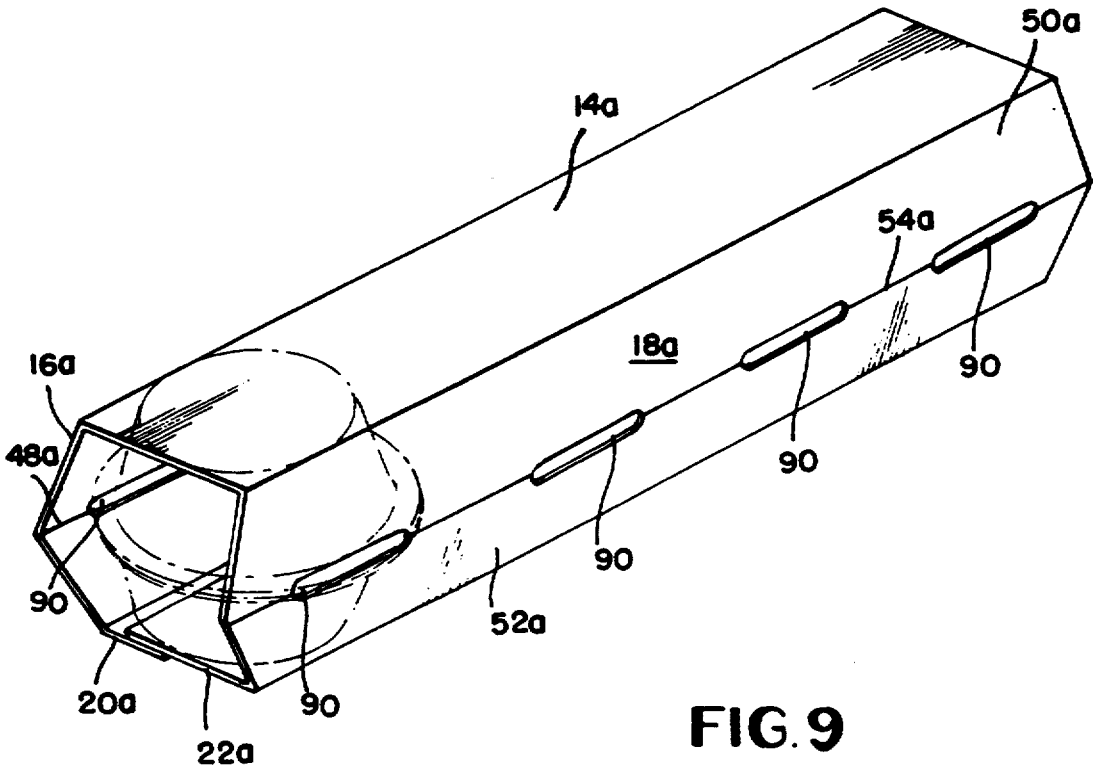
FIG. 9 is a perspective view of a package of another embodiment according to the invention.

FIG. 9 illustrates a further variation of the package of the invention. Because the package of FIG. 9 is similar to that of FIG. 7, parts similar to the parts in FIG. 7 are identified by the same reference numerals with the subscript "a". The package of FIG. 9 unlike the package of FIG. 7 includes no web structures but slots 90 for receiving the cup flanges. These slots 90 are provided not only for the pairs of upper and lower cups located at the carton ends but also for all the other pairs of cups. These slots 90 are extended along the central fold lines 48*a* and 54*a* so that each slot receives the mated flanges of the adjacent pair of upper and lower cups to prevent movement of the cups in the direction along the longitudinal axis of the carton sleeve. As is obvious, the package of FIG. 9 is formed through virtually identical steps to those described for the package of FIG. 7.

What is claimed is:

1. A package comprising:

a plurality of flanged articles arranged into a group of upper and lower vertically-aligned tiers, each of said articles having a tubular side wall defining a tube axis and a peripheral flange at a top end of said side wall, said articles in said upper tier being arranged in top-to-top contacting relationship with said articles in said lower tier so that said flanges of said articles are disposed intermediate said upper and lower tiers while said axes of said articles in each tier are disposed vertically and parallel to each other; and a carton disposed around said group of said articles and including top and bottom panels interconnected by a pair of side panels to form a sleeve structure having opposite open ends, said top panel being disposed over bottoms of said articles in said upper tier, said bottom panel being disposed under bottoms of said articles in said lower tier, said side panels being disposed alongside said side walls of said articles in said group, said carton including article retaining means for engaging both said flanges of a pair of vertically aligned ones of said articles located at one of said open ends of said carton so as to prevent dislodgement of said pair of articles from said one open end.

2. The package according to claim 1, wherein said retaining means is formed in association with one of said side panels and is positioned adjacent to said one open end of said carton.

3. The package according to claim 2, wherein said one side panel includes upper and lower portions foldably joined together along a fold line extending along said flanges of said articles, said one side panel being folded along said fold line so that said upper and lower portions are disposed in an angular relationship, and said retaining means is positioned adjacent to said fold line.

4. The package according to claim 3, wherein said retaining means comprises a web structure interposed between inside surfaces of said upper and lower portions, said web structure being disposed astride said flanges of said pair of articles.

5. The package according to claim 4, wherein said retaining means further comprises upper and lower anchoring flaps foldably joined respectively to said upper and lower portions at said one open end, said upper and lower anchoring flaps being folded into flat face contacting relation respectively with inside surfaces of said upper and lower portions and being interconnected by said web structure.

6. The package according to claim 5, wherein said web structure comprises a pair of upper and lower web flaps, said upper web flap being foldably joined to a lower end of said upper anchoring flap and extending therefrom to an inner end, said lower web flap being foldably joined to an upper end of said lower anchoring flap and extending therefrom to an inner end, said upper and lower web flaps being foldably joined together at said inner ends thereof along a fold line.

7. The package according to claim 2, wherein said retaining means comprises a web structure connected to said one side panel of said carton and formed on an inside surface of said one side panel to project therefrom, said web structure being positioned astride said flanges of said pair of articles.

8. The package according to claim 7, wherein said web structure comprises a pair of upper and lower web flaps foldably joined together along a fold line, said upper web flap being positioned above said flanges of said pair of articles, said lower web flap being positioned below said flanges of said pair of articles.

9. The package according to claim 7, wherein said retaining means further comprises a pair of upper and lower anchoring flaps foldably joined to an end edge of said one side panel, said upper and lower anchoring flaps being folded into flat face contacting relation with said inside surface of said one side panel, said upper and lower anchoring flaps being interconnected by said web structure.

10. The package according to claim 9, wherein said web structure comprises a pair of upper and lower web flaps, said upper web flap being foldably joined to a lower end of said upper anchoring flap and extending therefrom to an inner end, said lower web flap being foldably joined to an upper end of said lower anchoring flap and extending therefrom to an inner end, said upper and lower web flaps being foldably joined together at said inner ends thereof along a fold line.

11. The package according to claim 10, wherein said carton of said sleeve structure defines a sleeve axis, said one side panel is provided with a center fold line extending generally parallel to said sleeve axis along said flanges of said articles in said group, and said one side panel is folded about said center fold line to be disposed generally along said side walls of both said articles in said upper tier and said articles in said lower tier.

12. The package according to claim 11, wherein said one side panel is divided by said center fold line into upper and lower portions, and said upper and lower anchoring flaps are foldably joined to said upper and lower portions respectively.

13. The package according to claim 2, wherein said carton further includes second article retaining means for engaging both said flanges of a pair of vertically aligned ones of said articles located at the other open end of said carton so as to prevent dislodgement of said pair of articles from said other open end.

14. The package according to claim 2, wherein said article retaining means comprises a slot formed in said one side panel so as to receive said flanges of said pair of articles.

15. The package according to claim 3, wherein said article retaining means comprises a slot formed in said one side panel so as to receive said flanges of said pair of articles, and said retaining means is disposed along said fold line.

16. A method of forming a package comprising the steps of:

arranging a plurality of articles into a group of upper and lower vertically-aligned tiers, each of said articles having a tubular side wall defining a tube axis and a peripheral flange at a top end of said side wall, said articles in said upper tier being arranged in top-to-top contacting relationship with said articles in said lower tier so that said flanges of said articles are disposed intermediate said upper and lower tiers while said axes of said articles in each tier are disposed vertically and parallel to each other; and covering said group of said articles with a carton including a top panel, a pair of side panels foldably joined to opposite side edges of said top panel, a pair of bottom flaps foldably joined respectively to said side panels at edges thereof remote from said opposite side edges of said top panel, and article retaining means associated with one of said side panels for engagement with said flanges of said articles so as to prevent dislodgement of said articles from said carton, said covering step comprising placing said carton blank above said group of said articles so that said top panel overlies bottoms of said articles in said upper tier, folding said side panels down relative to said top panel towards said group of said articles and engaging said retaining means at one time with both said flanges of an adjacent pair of vertically aligned ones of said articles thereby positioning said pair of articles with respect to each other as well as positioning said carton with respect to said pair of articles, folding said bottom flaps toward each other, and securing said bottom flaps together to form a composite bottom panel disposed under bottoms of said articles in said lower tier.

17. The method according to claim 16, wherein said retaining means comprises a web structure connected to said one side panel and formed on an inside surface of said one side panel to project from said inside surface, and said engaging step comprises placing said web structure at a position where said web structure is disposed astride said flanges of said pair of articles.

18. A carton comprising a plurality of flanged articles arranged into a group of upper and lower vertically-aligned tiers, each of said articles having a tubular side wall defining a tube axis and a peripheral flange at a top end of said side wall, said articles in said upper tier being arranged in top-to-top contacting relationship with said articles in said lower tier so that said flanges of said articles are disposed intermediate said upper and lower tiers while said axes of said articles in each tier are disposed vertically and parallel to each other, top and bottom panels interconnected by a pair of side panels to form a sleeve structure having opposite open ends, said top panel being disposed over bottoms of said articles in said upper tier, said bottom panel being disposed under bottoms of said articles in said lower tier, said side panels being disposed alongside said side walls of said articles in said group; and article retaining means for engaging both said flanges of a pair of vertically aligned ones of said articles located at one of said open ends of said carton so as to prevent dislodgement of said pair of articles from said one open end.

19. A blank for forming a carton comprising:

a first panel having opposite side edges;

a pair of second panels each having first and second opposite edges, said second panels being foldably joined at said first edges thereof to said opposite side edges of said first panel respectively;

a pair of third panels foldably joined to said second edges of said second panels respectively; and means for securing said third panels together so that said third panels form a composite carton wall when secured together, each of said second panels comprising a pair of trapezoidal panel portions each having longer and shorter parallel edges, said trapezoidal portions of said each second panel being foldably joined together along said longer parallel edges thereof.

* * * * *